US007445750B1

(12) United States Patent
Beguinot et al.

(10) Patent No.: US 7,445,750 B1
(45) Date of Patent: Nov. 4, 2008

(54) REINFORCED DURABLE STEEL, METHOD FOR THE PRODUCTION THEREOF, METHOD FOR PRODUCING PARTS MADE OF STEEL, AND PARTS THUS OBTAINED

(75) Inventors: Jean Beguinot, Le Creusot (FR); Dominique Viale, Marmagne (FR)

(73) Assignee: USINOR, Puteaux (FR)

( * ) Notice: Subject to any disclaimer, the term of this patent is extended or adjusted under 35 U.S.C. 154(b) by 413 days.

(21) Appl. No.: 10/474,841

(22) PCT Filed: Apr. 16, 2002

(86) PCT No.: PCT/FR02/01302

§ 371 (c)(1),
(2), (4) Date: Mar. 12, 2004

(87) PCT Pub. No.: WO02/083966

PCT Pub. Date: Oct. 24, 2002

(30) Foreign Application Priority Data

Apr. 18, 2001 (FR) ..... 01 05225

(51) Int. Cl.

| | |
|---|---|
| ***C22C 38/22*** | (2006.01) |
| ***C22C 38/28*** | (2006.01) |
| ***C22C 38/24*** | (2006.01) |
| ***C22C 38/04*** | (2006.01) |
| ***C21D 8/00*** | (2006.01) |
| ***C21D 7/13*** | (2006.01) |

(52) U.S. Cl. ..... 420/101; 420/102; 420/68; 420/69; 420/109; 420/110; 420/111; 420/129; 148/326; 148/328; 148/334; 148/335; 148/540; 148/542; 148/546; 148/547

(58) Field of Classification Search ..... 420/99–102, 420/68, 69, 104–111, 129; 148/328, 326, 148/334, 335, 540, 542, 546, 547
See application file for complete search history.

(56) References Cited

U.S. PATENT DOCUMENTS

| | | | | |
|---|---|---|---|---|
| 1,775,615 A | * | 9/1930 | Succop | 420/12 |
| 3,295,966 A | * | 1/1967 | Steven | 420/101 |
| 5,972,129 A | | 10/1999 | Beguinot et al. | |

FOREIGN PATENT DOCUMENTS

| | | | | |
|---|---|---|---|---|
| EP | 458 646 A1 | | 11/1991 | |
| EP | 475 804 A1 | | 3/1992 | |
| JP | 52-14513 | * | 2/1977 | |
| JP | 57-143468 | * | 9/1982 | 420/37 |
| JP | 62-208457 | * | 10/1985 | |
| JP | 401011945 | * | 1/1989 | |
| SU | 996506 | * | 2/1983 | |
| WO | WO 99/50469 A1 | | 10/1999 | |

OTHER PUBLICATIONS

English translation of Japanese patent 57143468, Fukui, Shoichi et al., Sep. 4, 1982.*
Patent Abstracts of Japan, vol. 2000, No. 10, Nov. 17, 200 & JP 2000 192195 (DAIDO Steel Co., Ltd.), Jul. 1, 2000.
Patent Abstracts of Japan, vol. 015, No. 216 (C-0837), Jun. 4, 1991 & JP 03 064429 A. (DAIDO Steel Co., Ltd.), Mar. 19, 1991.
Patent Abstracts of Japan, vol. 017, No. 554 (C-1118), Oct. 6, 1993 & JP 05 156407 A. (Hitachi Metals, Ltd.), Jun. 22, 1993.

* cited by examiner

*Primary Examiner*—Deborah Yee
(74) *Attorney, Agent, or Firm*—Sughrue Mion, PLLC

(57) ABSTRACT

The invention relates to a tool steel, the composition of which comprises (the percentages being expressed in % by weight):

| | | | | |
|---|---|---|---|---|
| 0.8 | ≦ | C | ≦ | 1.5 |
| 5.0 | ≦ | Cr | ≦ | 14 |
| 0.2 | ≦ | Mn | ≦ | 3 |
| | | Ni | ≦ | 5 |
| | | V | ≦ | 1 |
| | | Nb | ≦ | 0.1 |
| | | Si + Al | ≦ | 2 |
| | | Cu | ≦ | 1 |
| | | S | ≦ | 0.3 |
| | | Ca | ≦ | 0.1 |
| | | Se | ≦ | 0.1 |
| | | Te | ≦ | 0.1 |
| 1.0 | ≦ | Mo + ½W | ≦ | 4 |
| 0.06 | ≦ | Ti + ½Zr | ≦ | 0.15 |
| 0.004 | ≦ | N | ≦ | 0.02 |

the balance of the composition consisting of iron and impurities resulting from the smelting, it being furthermore understood that: $2.5\times10^{-4}\%^2 \leqq (Ti+\frac{1}{2}Zr)\times N$, to a process for manufacturing parts made in this steel and to the parts obtained.

11 Claims, No Drawings

REINFORCED DURABLE STEEL, METHOD FOR THE PRODUCTION THEREOF, METHOD FOR PRODUCING PARTS MADE OF STEEL, AND PARTS THUS OBTAINED

The present invention relates to a composition for tool steel having greater toughness than grades of the prior art, to a process for producing this composition and to the parts that can thus be obtained.

Tool steels are very widely used in many applications, especially those involving relative movement between metal parts in contact with one another, in which one of the parts must retain its geometrical integrity for as long as possible. As illustrative examples, mention may be made of machine and cutting tools and of metrological instruments.

The preservation of geometrical integrity of these parts requires good wear resistance, a good resistance to deformation and good strength under static or dynamic loads, which means that the steel used must have a high toughness and a high hardness.

Moreover, the grade must exhibit good hardenability so that the structure is as homogeneous as possible over large thicknesses after hardening.

However, these various requirements very often prove to be contradictory. Thus, a grade of tool steel for cold working, called AISI D2, is known and widely used, this steel containing by weight 1.5% carbon and 12% chromium with a few further additions of hardening carbide-forming elements such as Mo or V. The high carbon and chromium contents result in substantial precipitation of eutectic carbides of the $M_7C_3$ type which are formed at high temperature at the end of solidification and are consequently coarse and distributed non-homogeneously in the metal matrix.

Although the presence of a large volume fraction of hard carbides in the steel is favourable to increasing the wear resistance, their poor distribution is to the detriment of toughness.

To alleviate this problem, it has therefore been proposed to reduce the carbon and chromium contents of this type of grade to respective contents of about 1 and 8% with, in compensation, a higher molybdenum content of around 2.5% (EP 0 930 374). The reduction in carbon content allows the volume fraction of eutectic carbides to be reduced, this being favourable for toughness. The enrichment of these molybdenum carbides, which increases their hardness, makes it possible in turn to maintain the hardness of the steel and its wear resistance.

However, it would remain necessary to further refine the distribution of these carbides in order to increase the toughness without reducing the hardness and wear resistance properties of the steel.

The inventors have discovered that a new way of improving the compromise between toughness and mechanical strength and wear resistance unexpectedly results from a sufficient nitrogen content accompanied by a minimum titanium and/or zirconium content, which itself depends on the nitrogen content.

More specifically, they have observed a refinement of the chromium, molybdenum and tungsten carbides jointly with an increase in toughness when:

on the one hand, $N \geqq 0.004\%$, preferably $\geqq 0.006\%$, and, on the other hand, $(Ti+\frac{1}{2}Zr)\times N \geqq 2.5\times10^{-4}\%^2$, the Ti, Zr and N contents being expressed in % by weight.

This joint requirement in terms of nitrogen and titanium or zirconium suggests that the active factor is the presence of titanium and/or zirconium nitrides, these being assumed to have the function of refining the size of the chromium, molybdenum and tungsten carbides. The mean size of the coarse chromium, molybdenum and tungsten carbides thus goes from a typical value of about 10 μm according to the prior art to a value of about 4 μm according to the present invention.

A first subject of the invention thus consists of a steel, the composition of which comprises (the percentages being expressed in % by weight):

| | | | | |
|---|---|---|---|---|
| 0.8 | ≦ | C | ≦ | 1.5 |
| 5.0 | ≦ | Cr | ≦ | 14 |
| 0.2 | ≦ | Mn | ≦ | 3 |
| | | Ni | ≦ | 5 |
| | | V | ≦ | 1 |
| | | Nb | ≦ | 0.1 |
| | | Si + Al | ≦ | 2 |
| | | Cu | ≦ | 1 |
| | | S | ≦ | 0.3 |
| | | Ca | ≦ | 0.1 |
| | | Se | ≦ | 0.1 |
| | | Te | ≦ | 0.1 |
| 1.0 | ≦ | Mo + ½W | ≦ | 4 |
| 0.06 | ≦ | Ti + ½Zr | ≦ | 0.15 |
| 0.004 | ≦ | N | ≦ | 0.02 |

the balance of the composition consisting of iron and impurities resulting from the smelting, it being furthermore understood that: $2.5\times10^{-4}\%^2 \leqq (Ti+\frac{1}{2}Zr)\times N$.

In a preferred embodiment of the invention, the steel composition comprises (the percentages being expressed in % by weight):

| | | | | |
|---|---|---|---|---|
| 0.8 | ≦ | C | ≦ | 1.2 |
| 7.0 | ≦ | Cr | ≦ | 9 |
| 0.2 | ≦ | Mn | ≦ | 1.5 |
| | | Ni | ≦ | 1 |
| 0.1 | ≦ | V | ≦ | 0.6 |
| | | Nb | ≦ | 0.1 |
| | | Si + Al | ≦ | 1.2 |
| | | Cu | ≦ | 1 |
| | | S | ≦ | 0.3 |
| | | Ca | ≦ | 0.1 |
| | | Se | ≦ | 0.1 |
| | | Te | ≦ | 0.1 |
| 2.4 | ≦ | Mo + ½W | ≦ | 3 |
| 0.06 | ≦ | Ti + ½Zr | ≦ | 0.15 |
| 0.004 | ≦ | N | ≦ | 0.02 |

the balance of the composition consisting of iron and impurities resulting from the smelting, it being furthermore understood that: $2.5\times10^{-4}\%^2 \leqq (Ti+\frac{1}{2}Zr)\times N$.

The titanium and/or zirconium content of the steel according to the invention must be between 0.06 and 0.15% by weight. This is because above 0.15% by weight, the precipitation of titanium and/or zirconium nitrides tends to coalesce and lose its effectiveness. On the other hand, if the content is less than 0.06% by weight, the amount of titanium and/or zirconium present is insufficient to form enough titanium and/or zirconium carbides to obtain the desired improvement in toughness and in wear resistance. It should be noted that zirconium may be completely or partly substituted with titanium in the proportion of two parts of zirconium for one part of titanium.

The nitrogen content of the steel according to the invention must be between 0.004 and 0.02% by weight, preferably between 0.006 and 0.02% by weight. Its content is limited to 0.02% by weight since above this the toughness tends to decrease.

The carbon content of the steel according to the invention must be between 0.8 and 1.5% by weight, preferably between 0.8 and 1.2% by weight. Carbon must be present in an amount sufficient to form carbides and reach the hardness level that it is desired to obtain for the grade.

In another preferred embodiment, the carbon content of the steel according to the invention is between 0.9% and 1.5% by weight so as to ensure improved hardness, for the same heat treatment, and to increase the wear resistance by increasing the volume fraction of hard carbides.

The chromium content of the steel according to the invention must be between 5 and 14% by weight, preferably between 7 and 9% by weight. This element makes it possible, on the one hand, to increase the hardenability of the grade and, on the other hand, to form hardening carbides.

The manganese content of the steel according to the invention must be between 0.2 and 3% by weight, preferably between 0.2 and 1.5% by weight. This is added to the grade according to the invention as it is a hardening element, but its content is limited in order to limit the segregation which would result in poor forgeability and too low a toughness.

The steel may contain up to 5% by weight of nickel. Preferably, the content of this element must remain less than 1% by weight. It may be added to the grade according to the invention as it is a hardening element, and it poses no segregation problem. However, its content is limited as it is an element forming the gamma-phase favourable to a formation of residual austenite.

To improve the resistance to softening in the frequent case in which the steel is tempered before use, it is useful to add strong carbide-forming elements to the composition, these forming fine carbides of the MC type during tempering.

Among these, vanadium is preferred and in this case contents of at least 0.1%, but not exceeding 1%, preferably less than 0.6%, are used.

Niobium, which tends to precipitate at higher temperature and which, consequently, greatly impairs the forgeability of the steel, is to be avoided and in any case should not exceed 0.1% and will preferably be less than 0.02% by weight.

The silicon and/or aluminium content of the steel according to the invention must be less than 2% by weight. Apart from their function of deoxidizing the grade, these elements make it possible to slow down the coalescence of the carbides at temperature and consequently reduce the rate of softening during tempering. Their content is limited, as above 2% by weight they embrittle the grade.

The molybdenum and/or tungsten content of the steel according to the invention must be between 1 and 4% by weight, preferably between 2.4 and 3% by weight. It will be noted that tungsten may be substituted completely or partly with molybdenum in the proportion of two parts of tungsten for one part of molybdenum. These two elements make it possible to improve the hardenability of the grade and form hardening carbides. Their content is limited as they are the cause of segregation.

Copper may be present in the steel, but in an amount of less than 1% in order not to impair the forgeability of the grade.

Moreover, to improve the machinability of the steel, sulphur, in a content not exceeding 0.3%, may be added, possibly accompanied by calcium, selenium or tellurium, each in contents of less than 0.1%.

The smelting of the steel grade according to the invention, including the method of adding titanium and/or zirconium, may be carried out by any conventional process, but it may advantageously be carried out by the process according to the invention, which constitutes a second subject of the invention.

This process for manufacturing parts comprises a first step consisting in smelting a liquid steel by melting all the elements of the grade according to the invention, with the exception of the titanium and/or zirconium, and then in adding the titanium and/or zirconium to the bath of molten steel while preventing at all times any local overconcentrations of titanium and/or zirconium in the bath of molten steel.

This is because the present inventors have discovered that the conventional methods of addition, according to the prior art, of titanium and zirconium in the form of solid iron-alloy or metallic elements, produce coarse, and consequently few, titanium and/or zirconium nitrides, the more so as some of them may then even settle. This situation seems to be linked to the fact that these addition processes cause large local over concentrations of titanium and/or zirconium in the liquid in the region of the added elements.

One of the ways of carrying out this first step of the process according to the invention consists in continuously adding titanium and/or zirconium to the slag covering the bath of liquid steel, the titanium and/or zirconium then progressively spilling out into the bath of steel.

Another way of implementing this first step of the process according to the invention consists in adding the titanium and/or zirconium by continuously introducing a wire composed of this or these elements into the bath of molten steel, while stirring the bath by bubbling or by any other suitable method.

Another way of implementing this first step of the process according to the invention consists in adding the titanium and/or zirconium by blowing a powder containing this or these elements into the bath of molten steel, while stirring the bath by bubbling or by any other suitable method.

Within the context of the present invention, it is preferred to use the various methods of implementation that have just been described, but it is understood that any process allowing a local titanium and/or zirconium overconcentration to be avoided can be used.

The smelting is generally carried out in an arc furnace or in an induction furnace.

After this smelting operation, the liquid steel is cast into ingots or slabs. In order to refine its structure, in-mould stirring may be carried out or else the process of electroslag remelting with a consumable electrode may be used.

These ingots or slabs are then converted by means of suitable forming treatments by hot plastic deformation, such as forging or rolling for example.

The steel may then be subjected to a heat treatment using conventional means for tool steels. Such a heat treatment may optionally include an annealing step in order to make it easier for cutting and machining, and then an austenization step followed by a cooling step using a method which depends on the thickness, such as air cooling or oil cooling, possibly followed by annealing steps depending on the hardness level that it is desired to achieve.

A third subject of the invention consists of a part made of steel having the composition according to the invention or obtained by implementing the process according to the invention, and of which the mean size of the chromium, molybdenum or tungsten carbide precipitates resulting from the solidification is between 2.5 and 6 μm, preferably between 3 and 4.5 μm.

The present invention is illustrated by the following observations and examples, Table 1 giving the chemical composition of the steels tested, among which Heat 1 is according to the present invention, while Heat 2 is given as a comparison.

| Composition (% by weight) | Heat 1 | Heat 2 |
|---|---|---|
| C | 0.98 | 0.96 |
| Cr | 8.40 | 8.20 |
| Mn | 0.79 | 0.83 |
| Ni | 0.35 | 0.31 |
| Cu | 0.26 | 0.22 |
| V | 0.37 | 0.40 |
| Nb | 0.01 | 0.09 |
| Si | 0.97 | 0.94 |
| Al | 0.03 | 0.03 |
| Mo | 2.60 | 2.50 |
| W | — | — |
| Ti | 0.11 | 0.004 |
| Zr | — | — |
| N | 0.011 | 0.009 |

Abbreviations used:

VL: volume loss, expressed in $mm^3$;

$K_V$: fracture energy, expressed in $J/cm^2$;

T: toughness, expressed in $J/cm^2$.

EXAMPLE 1

Toughness

Two parts were manufactured from Heat 1 according to the invention and comparative Heat 2, by rolling, at 1150° C., ingots produced from these compositions. The specimens were then austenized at 1050° C. for one hour, oil-quenched and then double-tempered at 525° C. for one hour in order to obtain a Rockwell C hardness of 60.

Next, two series of tests were carried out using different methods to measure the toughness:

an impact bending test on a Charpy test piece having the shape of a V-notched bar according to the NF EN 10045-2 standard, which gives the fracture energy $K_V$; and an impact bending test on an unnotched bar (a 10 mm by 10 mm bar), which gives the toughness T.

The results obtained are given in the following table:

| | $K_V$ ($J/cm^2$) | T ($J/cm^2$) |
|---|---|---|
| Heat 1 | 14.0 | 59 |
| Heat 2 | 10.5 | 47 |

It may be seen that, whatever the method employed, Heat 1 according to the invention has a better toughness than comparative Heat 2.

EXAMPLE 2

Wear Resistance

Two parts were manufactured in a manner similar to that used in Example 1 and the wear resistance was measured according to the ASTM G52 standard which allows the volume loss suffered by the specimens tested to be determined. This test consists in measuring the loss of weight of the specimen subjected to the abrasive wear of a stream of quartz sand having a calibrated particle size, introduced between a rubber-coated wheel and the stationary specimen.

The results obtained are given in the following table:

| | VL ($mm^3$) |
|---|---|
| Heat 1 | 17.5 |
| Heat 2 | 18.5 |

It may be seen that Heat 1 according to the invention has a slightly better wear resistance than comparative Heat 2.

The invention claimed is:

1. Tool steel, the composition of which consisting of (the percentages being expressed in % by weight):

| | | | | |
|---|---|---|---|---|
| 0.8 | ≦ | C | ≦ | 1.5 |
| 7.0 | ≦ | Cr | ≦ | 14 |
| 0.2 | ≦ | Mn | ≦ | 3 |
| | | Ni | ≦ | 5 |
| | | V | ≦ | 1 |
| | | Nb | ≦ | 0.1 |
| | | Si + Al | ≦ | 2 |
| | | Cu | ≦ | 1 |
| | | S | ≦ | 0.3 |
| | | Ca | ≦ | 0.1 |
| | | Se | ≦ | 0.1 |
| | | Te | ≦ | 0.1 |
| 1.0 | ≦ | Mo + ½W | ≦ | 4 |
| 0.06 | ≦ | Ti + ½Zr | ≦ | 0.15 |
| 0.004 | ≦ | N | ≦ | 0.02 |

the balance of the composition consisting of iron and impurities resulting from the smelting, it being furthermore understood that: $2.5\times10^{-4}\%^2 \leqq (Ti+\frac{1}{2}Zr)\times N$.

2. Steel according to claim 1, furthermore characterized in that the composition consists of (the percentages being expressed in % by weight):

| | | | | |
|---|---|---|---|---|
| 0.8 | ≦ | C | ≦ | 1.2 |
| 7.0 | ≦ | Cr | ≦ | 9 |
| 0.2 | ≦ | Mn | ≦ | 1.5 |
| | | Ni | ≦ | 1 |
| 0.1 | ≦ | V | ≦ | 0.6 |
| | | Nb | ≦ | 0.1 |
| | | Si + Al | ≦ | 1.2 |
| | | Cu | ≦ | 1 |
| | | S | ≦ | 0.3 |
| | | Ca | ≦ | 0.1 |
| | | Se | ≦ | 0.1 |
| | | Te | ≦ | 0.1 |
| 2.4 | ≦ | Mo + ½W | ≦ | 3 |
| 0.06 | ≦ | Ti + ½Zr | ≦ | 0.15 |
| 0.004 | ≦ | N | ≦ | 0.02 |

the balance of the composition consisting of iron and impurities resulting from the smelting, it being furthermore understood that: $2.5\times10^{-4}\%^2 \leqq (Ti+\frac{1}{2}Zr)\times N$.

3. Steel according to claim 1, furthermore characterized in that the niobium content is less than or equal to 0.02% by weight.

4. Steel according to claim 1, furthermore characterized in that the nitrogen content is between 0.006 and 0.02% by weight.

5. Process for manufacturing a part made of a steel of composition according to claim 1, characterized in that:

a liquid steel is smelted by melting all the elements of the said composition, with the exception of the titanium and/or zirconium, and then titanium and/or zirconium is/are added to the bath of molten steel, while preventing at all times any local over concentrations of titanium and/or zirconium in the bath of molten steel;

the said liquid steel is cast in order to obtain an ingot or slab; and the said ingot or slab is subjected to a forming treatment by hot plastic deformation and then optionally to a heat treatment in order to obtain the said part.

6. Process according to claim 5, characterized in that the titanium and/or zirconium is/are continuously added to a slag covering the bath of liquid steel, the titanium and/or zirconium then progressively spilling out into the said steel bath.

7. Process according to claim 5, characterized in that the addition of the titanium and/or zirconium is carried out by continuously introducing a wire composed of titanium and/or zirconium into the bath of steel, while stirring the said bath.

8. Process according to claim 5, characterized in that the addition of titanium and/or zirconium is carried out by blowing a powder containing titanium and/or zirconium into the bath of molten steel, while stirring the bath.

9. Steel part having the steel composition according to claim 1, characterized in that the mean size of chromium, molybdenum or tungsten carbide precipitates resulting from solidification is between 2.5 and 6 μm.

10. Steel part according to claim 9, furthermore characterized in that the mean size of the chromium, molybdenum or tungsten carbide precipitates resulting from the solidification is between 3 and 4.5 μm.

11. The steel part obtained by implementing the process according to claim 5.

* * * * *